United States Patent [19]

Capra et al.

[11] Patent Number: 4,624,858

[45] Date of Patent: Nov. 25, 1986

[54] PROCESS FOR THE PRODUCTION BY CATALYSIS OF A LAYER HAVING A HIGH MAGNETIC ANISOTROPY IN A FERRIMAGNETIC GARNET

[75] Inventors: Thierry Capra, Lyons; Philippe Gerard, St. Ismier, both of France

[73] Assignee: Commissariat a l'Energie Atomique, Paris, France

[21] Appl. No.: 790,459

[22] Filed: Oct. 23, 1985

[30] Foreign Application Priority Data

Nov. 12, 1984 [FR] France ..... 84 17199

[51] Int. Cl.[4] ..... B05D 3/06

[52] U.S. Cl. ..... 427/38; 427/130; 427/131

[58] Field of Search ..... 427/128–132, 427/48, 38

*Primary Examiner*—Bernard D. Pianalto

*Attorney, Agent, or Firm*—Oblon, Fisher, Spivak, McClelland & Maier

[57] ABSTRACT

Process for producing a ferrimagnetic garnet layer having a high magnetic anisotropy on an amagnetic substrate, wherein it comprises the stages of forming at least one ferrimagnetic garnet layer by epitaxy from the amagnetic substrate, implanting ions in the ferrimagnetic garnet layer in order to produce defects therein, depositing on the ferrimagnetic garnet layer a metal layer able to activate and diffuse hydrogen into said garnet layer and heating under a hydrogen atmosphere of the complete structure, in order to bring about the diffusion of hydrogen into the ferrimagnetic garnet layer.

Application to the production of bubble stores with non-implanted propagation patterns.

6 Claims, 1 Drawing Figure

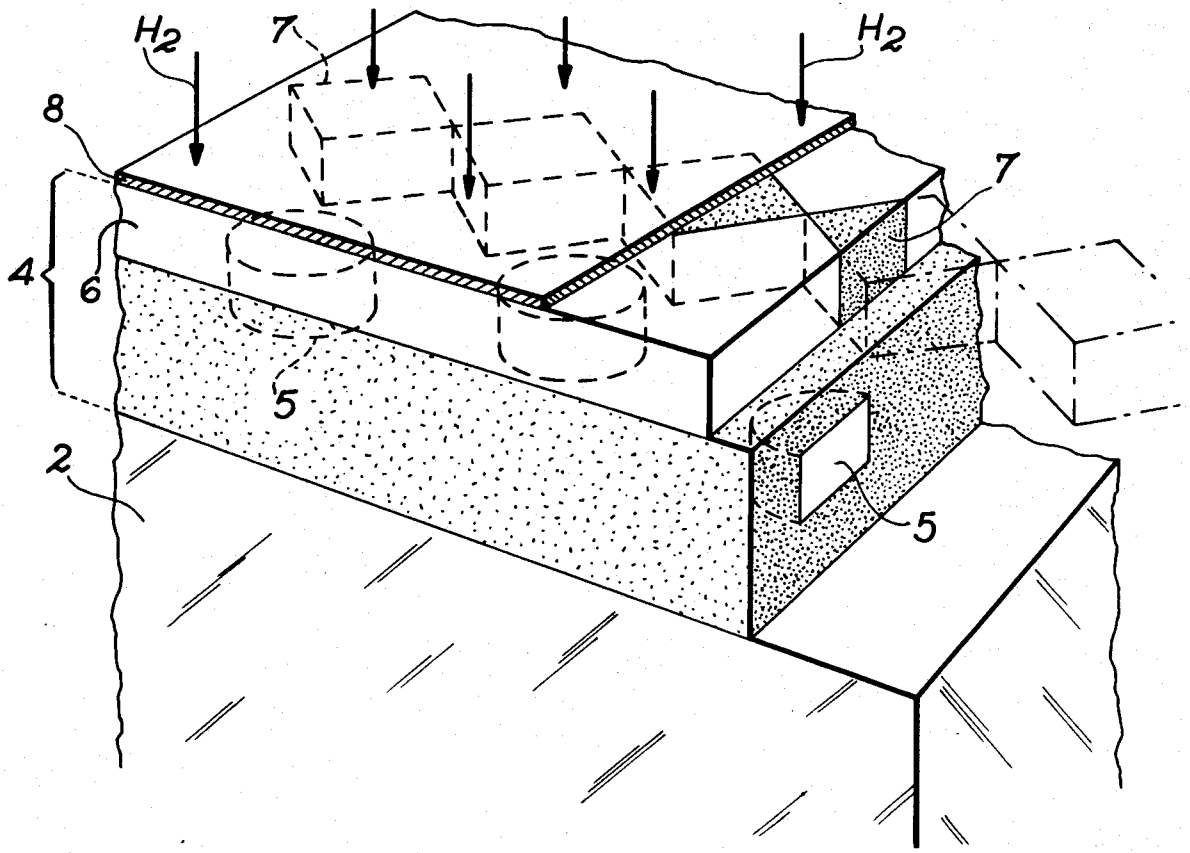
H2
7
5
H2
7
5
8
6
4
2

PROCESS FOR THE PRODUCTION BY CATALYSIS OF A LAYER HAVING A HIGH MANGETIC ANISOTROPY IN A FERRIMAGNETIC GARNET

BACKGROUND OF THE INVENTION

The present invention relates to a process for the production by catalysis of a layer having a high planar magnetic anisotropy in a ferrimagnetic garnet. It more particularly applies to the field of producing magnetic bubble stores and particularly non-implanted disk bubble stores, as well as in the field of producing magneto optical or semiconductor material.

In general terms, the production of a bubble store firstly consists of producing by epitaxy a ferrimagnetic garnet layer with growth anisotropy perpendicular to the layer on an amagnetic substrate, mainly a garnet. It is pointed out that magnetic bubbles are small magnetic domains, whose magnetization, directed perpendicular to the surface, is reversed compared with that of the material containing the bubbles. The ions are then implanted in the epitactic layer.

This ion implantation makes it possible to produce on the surface of the ferrimagnetic garnet layer a planar magnetization layer, i.e. a layer whose magnetization is parallel to the surface of said layer. This planar magnetization layer has the object of increasing the stability of the magnetic bubbles. This ion implantation makes it possible to produce planar magnetization layers over a thickness of approximately 0.5 $\mu$m.

By using an appropriate implantation mask, it is possible to define in the case of bubble stores with non-implanted patterns, propagation patterns, which are contiguous patterns, having the shape of a disk, lozenge, etc. As ion implantation is only carried out around these patterns, the latter are called non-implanted patterns.

In the case of bubble stores with patterns based on iron and nickel, ion implantation, apart from serving to form the surface layer with planar magnetization, is also used for eliminating the "hard" bubbles, i.e. the bubbles having structures with complex walls.

The propagation of the magnetic bubbles along the propagation patterns is realised by applying a rotary d.c. field in a direction parallel to the surface of the ferrimagnetic layer. The bubbles positioned below the planar magnetization surface layer are bonded to non-implanted propagation patterns via a potential well due to the stress field between the implanted and non-implanted zones. The displacement of the magnetic bubbles along the propagation patterns results from the action of the rotary field, which produces a mobile charged wall entraining the bubbles.

For a considerable time use has been made of the magnetostriction properties of the ferrimagnetic garnet layers to obtain said magnetic anisotropy of the surface layer. Thus, ion bombardment produces on the surface of the epitactic garnet layer, defects which consequently lead to a deformation of the mesh parameter in the direction perpendicular to said ferrimagnetic garnet layer. Within the garnet layer, said defects produce high mechanical stresses oriented parallel to the surface of said layer. It has been proved that an expansion of the mesh parameter could not be carried out parallel to the surface of the ferrimagnetic layer.

The ferrimagnetic garnet layers are produced so as to have a negative magnetostriction coefficient. In this case, a compressive stress obtained by ion implantation induces magnetic anisotropy in the plane of the implanted surface layer which exceeds the growth anisotropy of the starting material, i.e. the non-implanted material.

Unfortunately this magnetostriction mechanism has limits depending on the size of the growth anisotropy of the material (growth by epitaxy), as well as its negative magnetostriction coefficient. Thus, it is not possible to increase the implanted ion dose indefinitely, because beyond a certain threshold of the defects, the magnetism of the implanted surface layer is cancelled out and it is no longer possible to move the bubbles along the non-implanted propagation patterns.

However, in view of the fact that new generations of magnetic bubble stores and in particular non-implanted pattern stores tend to store ever higher information densities, it is necessary for ever decreasing sizes of the magnetic bubbles, which cannot be achieved using a material with a high growth anisotropy. Unfortunately, with such materials, it is no longer possible to obtain a planar magnetization in the implanted layer by a simple magnetostriction mechanism.

In order to increase the magnetic anisotropy of the implanted layer, no matter what the growth anisotropy of the starting material, consideration has recently been given to carrying out a reverse sputtering of argon ions in said implanted layer. This is carried out by heating a sample to above 100° C. This process is described in the article entitled "Magnetic and Crystalline Properties of Ion-implanted Garnet Fibres with Plasma Exposure" by K. Betsui et al, published at the Intermag Conference, Hamburg in 1984.

SUMMARY OF THE INVENTION

The present invention relates to another process for producing a layer having a high planar magnetic anisotropy in a ferrimagnetic garnet making it possible to obviate the disadvantages referred to hereinbefore.

It is based on the introduction by catalysis of hydrogen into the upper part of the implanted ferrimagnetic garnet layer.

More specifically the present invention relates to a process for producing a ferrimagnetic garnet layer having a high magnetic planar anisotropy on an amagnetic substrate, wherein it comprises the stages of forming at least one ferrimagnetic garnet layer by epitaxy from the amagnetic substrate, implanting ions in the ferrimagnetic garnet layer in order to produce defects in said layer, deposition on the ferrimagnetic garnet layer of a metal layer able to activate and diffuse hydrogen into said garnet layer and heating under a hydrogen atmosphere of the complete structure, in order to obtain hydrogen diffusion into the ferrimagnetic garnet layer.

According to the invention, the diffusion of hydrogen into the ferrimagnetic garnet layer using a metal layer serving as the catalyst makes it possible to very considerably increase the magnetic anisotropy of said layer. This magnetic anisotropy increase can, it would seem, be explained by a chemical interaction of the hydrogen at the defects produced during ion implantation, said defects giving rise to pending or free bonds.

According to a preferred embodiment of the process according to the invention, the metal layer is a palladium layer. Advantageously heat in the presence of hydrogen takes place at between 100° and 300° C.

According to another preferred embodiment of the process according to the invention, the metal layer has a thickness between 20 and 50 nm.

According to another embodiment of the process according to the invention, the implanted ions are neon ions.

The process for producing a ferrimagnetic garnet layer with a high planar magnetic anisotropy according to the invention can advantageously be used in the production of a bubble store with non-implanted propagation patterns.

In such an application, the process according to the invention comprises the stages of forming a ferrimagnetic garnet layer by epitaxy from the amagnetic substrate, implanting ions in the upper part of the ferrimagnetic garnet layer in order to produce defects in said part and form the propagation patterns, deposition on the ferrimagnetic garnet layer of a metal layer able to activate and diffuse hydrogen into the implanted part of the garnet layer and heating under a hydrogen atmosphere of the complete structure, in order to bring about hydrogen diffusion into the implanted part of the garnet layer.

DESCRIPTION OF THE DRAWING AND PREFERRED EMBODIMENTS

The invention is described in greater detail hereinafter relative to non-limitative embodiments and with reference to the single drawing illustrating the different stages of the process according to the invention in the scope of producing a bubble store with non-implanted patterns. This description is provided in connection with the production of non-implanted disk bubble stores, but obviously the invention has much more general applications, as stated hereinbefore.

As shown in the drawing, the first stage of the process consists of forming in per se known manner by epitaxy on an amagnetic substrate 2, such as of gadolinium gallate ($Gd_3Ga_5O_{12}$), a ferrimagnetic garnet layer 4, whereof the magnetization vector is oriented perpendicular to the surface of layer 4. In said ferrimagnetic layer 4 with a thickness of approximately 1000 nm there can be magnetic bubbles 5, in the presence of a polarizing field. The ferrimagnetic garnet can be a known material in accordance with the following formula $(YSmLuCa)_3\ (FeGe)_5\ O_{12}$.

The orientation of the magnetization vectors in the ferrimagnetic garnet layer 4 is due to a growth anisotropy of the materials obtained by an appropriate choice of the epitaxy conditions, which are well known in the art.

The following stage of the process consists of carrying out ion implantation in the ferrimagnetic layer 4 in order to obtain in the upper 6 thereof and over a thickness of approximately 300 nm the formation of defects. This ion implantation can be carried out with different types of ions, such as hydrogen, neon, nitrogen, oxygen, argon, etc. at a dose and energy such that the implanted upper part 6 of the ferrimagnetic layer 4 is not made amorphous and particularly so that the garnet layer loses its magnetic properties. In particular neon ion implantation can take place at a dose of $2\times10^{14}$ atoms/cm$^2$ and an energy of 200 keV.

Apart from the formation of defects in the upper part 6 of the ferrimagnetic garnet layer 4, ion implantation makes it possible to form in said part using an appropriate mask non-implanted propagation patterns 7 of magnetic bubbles 5.

Following said ion implantation, on ferrimagnetic layer 4 is deposited a metal layer 8 with a thickness between e.g. 20 and 50 nm. This metal layer 8 has the property of activating and diffusing hydrogen into the implanted part 6 of the ferrimagnetic layer 4, when the complete structure is brought into the presence of hydrogen.

As material constituting the metal layer 8, it is possible to use palladium or an alloy thereof, such as e.g. an alloy of palladium and silver or nickel, pure platinum or in the form of an alloy thereof. These different materials make it possible by different mechanisms to decompose the hydrogen gas into hydrogen atoms (nascent hydrogen formation), thus permitting its diffusion into the upper part of the ferrimagnetic layer 4. They serve as a diffusion catalyst. Advantageously use is made of a palladium material layer.

The following stage of the process consists of heating the complete structure in the presence of hydrogen, so as to permit the diffusion thereof into the upper part 6 of the ferrimagnetic layer 4. Heating is advantageously carried out at a temperature between 100° and 300° C. A temperature below 100° C. would lead to a relatively long diffusion time (several days), whereas a temperature above 300° C. would be prejudicial to obtaining a high planar magnetic anisotropy in the upper part 6 of the ferrimagnetic layer 4.

Thus, an excessively high temperature would lead to the reinstatement of the defects and in particular the closure of the pending bonds formed in the upper part 6 of the ferrimagnetic layer 4 during ion implantation. However, it is the presence of these defects which permits the formation of chemical bonds with the diffused hydrogen.

The heating time is a function of the heating temperature, as well as the hydrogen pressure used. The higher the heating temperature, the shorter the duration thereof for a given hydrogen pressure. In the same way, the higher the hydrogen pressure, the shorter the heating time for a given heating temperature. The stage of heating the structure in the presence of hydrogen can be carried out in one or more individual stages.

The stages described hereinbefore make it possible by varying the magnetic anisotropy to form a surface layer 6 having a planar magnetization and which is used more particularly for stabilizing the underlying magnetic bubbles 5.

The final stage of the process consists of either eliminating, particularly by chemical etching, the metal layer, or by forming therein by chemical etching the different electrical conductors necessary for producing within the bubble store the functions of writing, recording information, non-destructive reading, register-to-register transfer and erasure.

The embodiment of the inventive process described hereinbefore illustrates the significant increase obtained in the planar magnetic anisotropy of that part of the implanted ferrimagnetic layer 6 more particularly containing the non-implanted propagation patterns of the magnetic bubbles.

Following the implantation in the ferrimagnetic garnet layer 4 made from $(YSmLuCa)_3(FeGe)_5O_{12}$ of neon ions with a dose of $2\times10^{14}$ atoms/cm$^2$ and at an energy of 200 keV, determination took place of the magnetic anisotropy variation between the anisotropy of the new ferrimagnetic material and the implanted ferrimagnetic material by measuring the variation of the anisotropy magnetic field $\Delta H_K$ (in A/m) before and after treatment.

This was followed by the deposition of a palladium layer on said ferrimagnetic layer with a thickness of approximately 50 nm by vacuum evaporation and the anisotropy magnetic field variation was again measured. This was followed by a first heating of the structure obtained in the presence of hydrogen for 24 hours at 135° C. in a furnace and under a hydrogen pressure of 1 atmosphere ($10^5$ Pa). This was followed by a measurement of the magnetic anisotropy variation between the anisotropy of the new ferrimagnetic layer and the anisotropy of the treated ferrimagnetic layer.

Finally, a second heating of the structure obtained was carried out in the presence of hydrogen, the pressure thereof still being 1 atm., at a temperature of 144° C. for 22 hours 15 minutes. The variation of the anisotropy field between the anisotropy field of the new ferrimagnetic layer and that of the ferrimagnetic layer treated in this way was again measured.

In parallel, the same treatment and the same measurements as hereinbefore were carried out on a sample not covered with palladium and at each stage of the process the hydrogen concentration was determined by nuclear reaction with boron ions. The results obtained are given in the following table. It can be seen from this table that the magnetic anisotropy of the implanted ferrimagnetic layer had more than doubled through using the process according to the invention.

It should be noted that that part of the non-implanted ferrimagnetic layer containing the magnetic bubbles was not modified by the heating stages of the structure in the presence of hydrogen.

TABLE

| | BEFORE HEATING | | AFTER FIRST HEATING | | AFTER SECOND HEATING | |
|---|---|---|---|---|---|---|
| | Without Pd | With Pd | Without Pd | With Pd | Without Pd | With Pd |
| $\Delta H_K$ in A/m | $183 \cdot 10^3$ | $179 \cdot 10^3$ | $180 \times 10^3$ | $427 \times 10^3$ | $193 \times 10^3$ | $458 \times 10^3$ |
| Hydrogen | None | None | Little | Much | Little | Much |

What is claimed is:

1. A process for producing a complete structure of a ferrimagnetic garnet layer having a high magnetic anisotropy on an amagnetic structure, comprising the stages of:

(a) forming at least one ferrimagnetic garnet layer by epitaxy on the amagnetic substrate;

(b) implanting ions in the ferrimagnetic garnet layer in order to produce defects therein;

(c) depositing on the ferrimagnetic garnet layer a metal layer which is able to activate and diffuse hydrogen into said garnet layer; and (d) heating said complete structure under a hydrogen atmosphere, in order to bring about the diffusion of hydrogen into the ferrimagnetic garnet layer.

2. The process according to claim 1, wherein the metal layer is a palladium layer.

3. The process according to either of the claims 1 or 2, wherein the entity is heated to a temperature between 100° and 300° C.

4. The process according to any one of the claims 1 to 2, wherein the metal layer has a thickness between 20 and 50 nm.

5. The process according to any one of the claims 1 to 2, wherein the implanted ions are neon ions.

6. A process for the production of a bubble store with non-implanted propagation patterns, which has a ferrimagnetic garnet layer having a high planar magnetic anisotropy on an amagnetic substrate, comprising the steps of:

(a) forming a ferrimagnetic garnet layer by epitaxy on the amagnetic substrate;

(b) implanting ions in the upper part of the ferrimagnetic garnet layer in order to produce defects in said upper part and to form propagation patterns;

(c) depositing on the ferrimagnetic garnet layer a metal layer which is able to activate and diffuse hydrogen into the implanted portion of said garnet layer; and (d) heating said bubble store structure under a hydrogen atmosphere in order to bring about the diffusion of hydrogen into the implanted part of the garnet layer.

* * * * *